United States Patent [19]

Kelly et al.

[11] 3,934,975

[45] Jan. 27, 1976

[54] LEATHER TREATING PROCESS

[75] Inventors: James M. Kelly, Belford; John G. Papalos, Kearny, both of N.J.

[73] Assignee: Diamond Shamrock Corporation, Cleveland, Ohio

[22] Filed: Oct. 10, 1973

[21] Appl. No.: 405,113

Related U.S. Application Data

[60] Continuation of Ser. No. 206,969, Dec. 10, 1971, abandoned, which is a division of Ser. No. 93,839, Nov. 30, 1970, abandoned.

[52] U.S. Cl. ..... 8/94.24; 8/94.21; 8/94.1 P

[51] Int. Cl.[2] ..... C14C 3/18

[58] Field of Search ..... 8/94 P, 94.24, 94.21

[56] References Cited

UNITED STATES PATENTS 2,454,543 11/1948 Bock ..... 260/49

*Primary Examiner*—Donald Levy

*Attorney, Agent, or Firm*—Neal T. Levin; Leslie G. Nunn; John C. Tiernan

[57] ABSTRACT

Leather treating compositions are prepared which comprise condensed or polymeric alkyl phenol phosphates generally and more particularly an alkylphenol-polyphenol condensate subsequently alkoxylated and phosphated. These compositions may be utilized for leather processing, and specifically for: retanning, lubricating, and imparting water resistance to chrome and/or mineral tanned leather. Additionally, these compositions may be used to effect modifications of base mineral tannages for the purpose of dyeing, bleaching, and fatliquoring leather.

11 Claims, No Drawings

LEATHER TREATING PROCESS

This is a continuation, of application Ser. No. 206,969, filed Dec. 10, 1971 which in turn is a divisional of application Ser. No. 93,839 filed Nov. 30, 1970, both of said applications are abandoned.

BACKGROUND OF THE INVENTION

1. Field of the Invention

This invention relates to compositions for leather treating and processes for their use.

2. Description of the Prior Art

Chrome and/or mineral tanned leathers are at present retained with syntans, vegetable extracts and/or resins of various types. This is done to impart retan effects or characteristics which chrome and/or mineral tanned leather does not of itself possess. The effects or characteristics include: bleaching, dye assisting, plumping, increased weight, less shrinkage, better feel, better grain character, and buffability. Conventional retan material generally imparts to chrome and/or mineral tanned leather a positive characteristic of rewetting and water absorption. Conventional leather lubricants applied as emulsions (fatliquors) generally add to this characteristic of wetting. Various materials such as: hydrophobic rubbers and resins, fluorocarbons, fatty chrome complexes, silicones, and waxes, are applied on top of conventional retan and fatliquor treatments to overcome the undesirable rewetting and water absorption characteristic imparted by these treatments. In many cases the result is sub-standard. Known attempts to overcome this problem include the use of a fatliquor containing a polybasic acid ester (U.S. Pat. No. 2,950,950) and the use of a fatliquor containing an alkyl phosphate (U.S. Pat. No. 3,010,780). More recently, complete fatliquor systems incorporating alkyl phosphates as emulsifiers for leather oils have been developed to overcome the deficiencies of the above approaches. All of the above systems are effective in lubricating leather, but do not supply a sufficient degree of internal water resistance unless used in excess. In order to achieve increased internal water resistance with the above systems, sufficient fatliquor must be added to penetrate the leather deeply, resulting in poor leather character and quality.

SUMMARY OF THE INVENTION

This invention makes it possible to gain internal water resistance and maintain good leather quality, relying less on the penetration of fatliquor for its effect. This system replaces or supplements conventional retan materials thus improving the potential of all subsequent water repellant systems. This invention while providing better internal water resistance also provides retan effects. These effects are achieved by the use of novel leather treating compositions and by novel process using these compositions. The compositions comprise condensed or polymeric alkyl phenol phosphates generally and more particularly an alkylphenol-polyphenol condensate subsequently ethoxylated and phosphated. These compositions may be utilized for leather processing, and specifically for: retanning, lubricating effects such as softening and primarily for imparting water resistance to chrome and/or mineral tanned leather. Additionally, these compositions may be used to affect modifications of base mineral tannages for the purpose of dyeing, bleaching, and fatliquoring leather.

DESCRIPTION OF THE PREFERRED EMBODIMENTS

Useful alkyl phenols include those in which the alkyl moiety contains from 2 to 20 carbon atoms and is: saturated or unsaturated; primary, secondary or tertiary; branched or straight-chain; or a mixture of the above. Examples of useful alkyl moieties include, but are not limited to: dimethyl, ethyl, n-propyl, isopropyl, sec-butyl, tert-butyl, methylethyl, nonyl, decyl, dodecyl, pentadecyl, heptadecyl, eicosyl, diethylnonyl, hydroxymethyldodecyl, dimethyltetradecyl, and the like. Preferred alkyl moieties include those falling within the above description but which contain from about 6 to about 18 carbon atoms and which are saturated linear or branched chains. The phenol moiety may be any phenol or substituted phenol or mixture thereof. Examples of useful phenol moieties include, but are not limited to: monohydric, dihydric, and trihydric phenols; meta, ortho, and para phenols; and more specifically: hydroxybenzene, cresol, xylenol, chlorophenol, nitrophenol, 2,4-dinitrophenol, 1,3,5-trinitrophenol, 2-isopropyl-5-methylphenol, 2-methyl-5-isopropylphenol, o-dihydroxybenzene, m-dihydroxybenzene, p-dihydroxybenzene, 1-methyl-3,5-dihydroxybenzene, 1,2,3-trihydroxybenzene, 2,4,6-trihydroxybenzene, 1,2,4-trihydroxybenzene, fused ring phenols such as alpha-naphthol and beta-naphthol, pentachlorophenol, 2,4,6-tribromophenol, p-nitrosophenol, o-allylphenol, p-aminophenol, thiophenol, and the like. The preferred phenol moieties are hydroxybenzene and naphthols.

Useful polyphenols include all of the above mentioned phenol moieties multiplied so that there are from 2 to 15 benzene rings, as well as mixtures of the above phenol moieties combined so that there are from 2 to 15 benzene rings. Preferred polyphenols include: bis-(dihydroxybenzene); 2,2-bis(p-hydroxyphenyl) propane; 1,1-bis (p-hydroxyphenyl) ethane; and bis-(hydroxybenzene).

Useful aldehydes are defined as including aldehydes, substituted aldehydes, and aldehyde liberating compositions. Examples of useful aldehydes include, but are not limited to: formaldehyde, paraformaldehyde, trioxane, hexamethylene tetramine, formalin, acetaldehyde, butyraldehyde, heptaldehyde, furfuraldehyde, chloral, alpha-ethyl-betapropylacrolein, benzaldehyde, glyoxal, pyruvaldehyde, cinnamaldehyde, pyrocatechualdehyde, veratraldehyde, crotonaldehyde, diphenylacetaldehyde, 2-ethylisovaleraldehyde, glutaraldehyde, mucobromic acid, propionaldehyde, o-anisaldehyde, 9-anthraldehyde, bromobenzaldehyde, carboxybenzaldehyde, cyanobenzaldehyde, dibenzyloxybenzaldehyde, dibromosalicylaldehyde, dialdehyde starch, fluoronitrobenzaldehyde, indancarboxaldehyde, iodovanillin, isophthlaldehyde, mesitaldehyde, naphthaldehyde, nitropiperanol, syringaldehyde, tolualdehyde, bromoindolecarboxaldehyde, convallatoxin, cymarin, ferrocenecarboxaldehyde, helveticoside, methylfurfuraldehyde, methylthiophenecarboxaldehyde, norbornenecarboxaldehyde, K-strophanthin, and the like. The preferred aldehydes or aldehyde-liberating compositions are formaldehyde, paraformaldehyde, trioxane, hexamethylene tetramine, formalin, acetaldehyde, propanaldehyde, and butyraldehyde.

Useful phosphating agents include, but are not limited to: polyphosphoric acid, phosphorus pentoxide, pyrophosphoric acid, phosphoric acid, phospholeum (superphosphoric acid), phosphorous acid, phosphorous oxychloride, and the like. Preferred phosphating agents are polyphosphoric acid, phosphorous pentoxide, and phosphoric acid.

The general procedure for manufacturing the leather treating composition of this invention and the parameters of the ingredients thereof are as follows. Broadly, the procedure consists of condensing an alkyl phenol and a polyphenol with an aldehyde in the presence of an acid catalyst, neutralizing the catalyst with a strong base, alkoxylating the resulting polymer and phosphating the polymer in solution. Although phosphation of phenols directly is possible, it was considered better to facilitate the reaction by first alkoxylating the phenols.

The desired proportions of alkyl phenol to polyphenol to aldehyde can best be shown by the following table in which the numbers represent the various ingredients and their proportions in terms of benzene rings. Thus, for example, the "optimal ratio" represents a tetraphenol consisting of 2 phenols, each joined by 1 aldehyde, to 1 diphenol. Another example would be a 15 ring polyphenol to which is joined 1 phenol by 1 aldehyde. Still another example would be a diphenyl to which is joined 14 phenols by 14 aldehydes. Thus, if it were desired to produce a polymer having 8 benzene rings, one could use 1 mole of phenol with 1 mole of a 7 ring polyphenol and 1 mole of aldehyde; or 2 moles of phenol with 1 mole of a six ring polyphenol and 2 moles of aldehyde; or 3 moles of phenol with 1 mole of a 5 ring polyphenol and 3 moles of aldehyde, etc. The maximum total number of rings on the completed polymer is indicated by the column on the extreme right.

| ratio | (alkyl) phenol | polyphenol | aldehyde | total rings |
|---|---|---|---|---|
| lowest | 1 | 2 | 1 | 3 |
| optimal | 2 | 2 | 2 | 4 |
| highest preferred | 6 | 7 | 6 | 8 |
| highest | 14 | 15 | 14 | 16 |

More specifically, an alkyl phenol as described previously and a polyphenol as described previously are charged into a vessel and blended at a temperature of from about 25° to about 150°C and preferably 80° to 120°C. While blending, agitation is continued and about 0.1 to about 1 percent by weight as measured by the alkyl phenol-polyphenol mixture, of an acid catalyst is slowly added to the mixture. This catalyst may be any strong inorganic acid which will not react with an aromatic ring. Suitable acids include sulfuric acid, the halogen acids, and substituted halogen acids. A particularly useful acid is hydrochloric acid. Phosphoro- and nitro-acids are not suitable. It is important at this stage to provide for removal of acid fumes formed by the high temperature of the mixture. If excessive acid catalyst is lose due to evaporation, more can be added within the above indicated amounts. The mixture is then heated to from about 50° to 150°C and preferably from about 90° to about 130°C and an aldehyde as described previously is added to the mixture slowly over a period of from about 2 to about 6 hours, so that the temperature of the mixture is maintained at from about 50° to about 150°C and preferably from about 90° to about 140°C. The mixture is then further reacted at from about 60° to about 150°C and preferably from about 100° to about 140°C for from about 1 to 5 hours. A strong base is then added slowly in a sufficient quantity to completely neutralize the acid. The salt thus formed is inert and may either be removed or allowed to remain in the composition. Additional strong base is then added to make the resulting polymer mixture alkaline and facilitate alkoxylation. This base may be any inorganic alkaline substance which will not react with an aromatic ring and may be selected from among the group consisting of sodium hydroxide, calcium hydroxide, magnesium hydroxide, potassium hydroxide, alkaline oxides, and the like. The polymer, which until this time has been prepared under a nitrogen blanket, is then stripped of the water which is a by-product of the reaction with a vacuum source capable of pulling from about 26 to about 32 inches of mercury and is held at this reduced pressure for from about 15 to about 60 minutes until less than 0.1 percent water remains. The vacuum is then broken with a nitrogen blanket and the mixture is heated to from about 100° to about 160°C and preferably from about 115° to about 145°C. The polymer is then alkoxylated by adding an alkoxylating agent such as ethylene oxide, propylene oxide, butylene oxide, isobutylene oxide, mixtures thereof and the like. The preferred alkoxylating agent is ethylene oxide. The alkoxylating agent is added to the polymer in the ratio of from about 1 to about 20 moles and preferably from about 1 to about 3 moles, per hydroxy moiety of the polymer. The alkoxylation is carried out at a temperature of from about 100° to about 200°C and preferably at from about 120° to about 160°C at from about 10 to about 30 p.s.i.g. Solvent is then added to adjust the solids content of this composition to about 70 percent by weight for ease of handling. This polymer is selectively soluble in higher aromatic solvents such as toluene, chlorobenzene, xylene, and substituted chlorinated hydrocarbons such as ethylene dichloride. The preferred solvent is xylene. The composition thus produced is an intermediate polymer solution comprising an alkoxylated alkyl phenol-polyphenol condensate.

The leather treating composition is then prepared as follows. The intermediate polymer solution containing 70 percent solids by weight as prepared above is charged into a vessel and heated to from about 50° to about 70°C. The phosphating agent is then added in the ratio of from about 0.25 to about 4 moles and preferably from about 1 to about 2.5 moles per hydroxy moiety on the polymer. The phosphating agent, which is selected from among those described previously, is added slowly while maintaining the temperature at from about 50° to about 80°C. The mixture is then heated to from about 60° to about 150°C and preferably from about 80° to about 110°C and maintained at this temperature for from about 1½ to about 2½ hours, until phosphation is completed. A mixture of water and a strong base is then slowly added to adjust the composition to a neutral pH. The strong base may be selected from among any of those given above. Finally, additional water is added sufficient to adjust the solids content of the mixture to from about 35 to about 40% by weight.

EXAMPLE I

An intermediate polymer was prepared using the following ingredients:

| | Ingredient | Parts by Weight |
|---|---|---|
| (A) | octyl phenol | 30.03 |
| (B) | 2,2-bis (p-hydroxyphenyl) propane | 16.59 |

-continued

| | Ingredient | Parts by Weight |
|---|---|---|
| (C) | paraformaldehyde flakes | 4.56 |
| (D) | hydrochloric acid, 20°Bc. | .75 |
| (E) | potash caustic liquid, 45% | 1.08 |
| | | 53.01 |
| (F) | waste* | −3.41 |
| | | 49.60 |
| (G) | ethylene oxide | 19.71 |
| (H) | xylene, commercial | 30.69 |
| | | 100.00 |

*Waste material consists of water plus traces of HCl, formaldehyde, octyl phenol, and 2,2-bis (p-hydroxyphenyl) propane fumes.

The preparation of this polymer was as follows. This reaction was carried out under a nitrogen blanket when not in vacuo. Ingredients (A) and (B) were charged into a glass-lined reactor. The mixture was heated to 95°C and thoroughly blended with a variable speed agitator. While agitation was continued, ingredient (D) was slowly added over a period of 15 minutes. Provision was made for adequate ventilation to remove acid fumes generated during this step. The mixture was then heated to 105°C and ingredient (C) was added in 20 equal increments over a period of 3 to 4 hours, so that the temperature of the mixture was maintained at from 105°C to 110°C. The mixture was then reacted at 120±5°C for 3 hours to form a polymer. Ingredient (E) was then added slowly over a 30 minute period. The polymer was then stripped of water with a vacuum source capable of pulling 28 inches of mercury and held at reduced pressure for 30 minutes. The vacuum was then broken with a nitrogen blanket.

The mixture was then heated to 130°C and ingredient (G) was added. The temperature was raised to 140±10°C at 25 p.s.i.g. and the mixture was reacted for 30 minutes. Ingredient (H) was then added to adjust the solids content to about 70 percent.

EXAMPLE II

A leather treating composition was prepared using the following ingredients:

| | Ingredient | Parts by Weight |
|---|---|---|
| (A) | product of Example I | 35.40 |
| (B) | polyphosphoric acid | 8.26 |
| (C) | potash caustic, 45% liquid | 17.57 |
| (D) | water | 38.77 |

The preparation of this composition was as follows. Ingredient (A) was charged into a glass-lined reactor and heated to 60°C. Ingredient (B) was then slowly added over a period of 2 to 3 hours, while maintaining the temperature at 60°–70°C. The mixture was heated to 95±5°C and maintained at this temperature for 2 hours. The mixture was then cooled to less than 30°C. A premix of ingredients (C) and (D) was slowly added over a 2 hour period, while keeping the temperature of the mixture at less than 40°C. Additional amounts of ingredient (C) were then added to adjust the pH of a 5 percent solution to about 7. Finally, additional amounts of ingredient (D) were added to adjust the solids content of the mixture to about 37 percent. The composition thus produced was an effective leather treating composition within the scope of this invention.

EXAMPLE III

Application tests were conducted of products prepared in the manner of Example II, but phosphated (4) to 50 percent and (5) to 75 percent respectively as compared with (3) an alkyl diphenyl phosphate, (2) a substituted phenolic sulfonate, and (1) a chrome control in which there was no retannage. The tests were conducted in the following manner.

The leather used was Trostel stock 5–5 1/2 oz. grains. All percentages are based on the wrung split shave weight as received, which is normally 40 to 50 percent water. The application procedure was as follows:

1. The stock was washed in 400% water for 15 minutes and drained. This removed the majority of the loose chrome salts and acids.
2. The stock was refloated in 100 percent water at 80°F and neutralized with the following percentages of sodium bicarbonate and run for 30 minutes.

| | |
|---|---|
| Test 1 | 0.75% sodium bicarbonate |
| Test 2 | 0.50% sodium bicarbonate |
| Test 3 | 0.06% sodium bicarbonate |
| Test 4 | 0.06% sodium bicarbonate |
| Test 5 | 0.05% sodium bicarbonate |

The percentage of sodium bicarbonate was reduced for Tests 3–5 to compensate for the alkali content of samples.

3. The stock was washed in a float at 130°F for 10 minutes and drained, in order to remove remaining chrome salts as well as salts resulting from the neutralization step.
4. About 2 to 10 percent solids of the syntans to be tested per 100 percent water were added at 130°F and run for 1½ hours.
5. The systems were adjusted with formic acid to the lowest equilibrium pH and were run for 15 minutes.
6. The systems were adjusted with formic acid to a pH of 3.5 and run an additional 15 minutes.
7. The stock was washed for 10 minutes in cold water and mid-bend pieces were removed for non-fat observation.
8. The stock was heated to 130°F, washed for 10 minutes and drained.
9. The remaining pieces of stock were fatliquored with 8 percent solids per 100 percent float at 130°F. The fatliquor used was an emulsified oil, whose emulsifier is of a nonrewetting character.
10. The stock was rinsed, washed for 10 minutes and horsed up.
11. The stock was wrung out and tacked up to dry in an oven at 140°F for four hours.
12. The stock was allowed to lay over for 3 days to pick up moisture.
13. The stock was dried staked and tested for temper, water resistance, grain strength and light fastness.

EXAMPLE IV

The results of testing of the five stock prepared in Example III were as follows. The stocks were subjected to a standard Maeser flex test with the following results.

STOCK

| | 1* | 2* | 3* | 4* | 5* |
|---|---|---|---|---|---|
| A. Tests with Fatliquor (Step 9) Omitted | | | | | |
| No. of flexes for initial water penetration | 52 | 40 | 1020 | 234 | 200 |
| cc of water transmitted in 8,000 flexes | 9 | 19 | 4 | 33 | 22 |
| percentage of water compared to initial weight of stock absorbed in 8,000 flexes | 100 | 99 | 23 | 51 | 35 |

STOCK

| | 1* | 2* | 3* | 4* | 5* |
|---|---|---|---|---|---|
| B. Tests with Fatliquor (Step 9) included | | | | | |
| No. of flexes for initial water penetration | 510 | 340 | 4000 | 285 | 611 |
| cc of water transmitted in 8,000 flexes | 13 | 32 | 0.2 | 48 | 11 |
| percentage of water compared to initial weight of stock absorbed in 8,000 flexes | 55 | 56 | 12 | 25 | 10 |

*[1]Control stock - no retannage (step 4)
*[2]Syntan was a substituted phenolic sulfonate (50% solids) which is a conventional type
*[3]Syntan was an ethoxylated alkyl diphenyl phosphate (72% solids)
*[4]Syntan was an ethoxylated alkyl phenol-bisphenol which was 50% phosphated (80% solids) and which falls within the scope of this invention
*[5]Syntan was an ethoxylated alkyl phenol-bisphenol which was 75% phosphated (80% solids) and which falls within the scope of this invention The most important data relates to the percentage of water absorbed by the stock. Low water absorption is preferred and such a quality is indicated by a lower number. Although Stock No. 3 had the best water absorption resistance, this stock was completely unsatisfactory because of its poor esthetic qualities, namely, excessively coarse and loose break. Stock Nos. 4 and 5, which were within the scope of this invention, were clearly superior to Stock No. 1 which used no syntan and to Stock No. 2 which used a conventional syntan.

A test was then conducted to determine the temper of fatted and nonfatted stock using a Stubbings Temper Machine (Milwaukee School of Engineering). The results of this test are as follows.

STOCK

| 1 | 2 | 3 | 4 | 5 |
|---|---|---|---|---|
| A. Tests with Fatliquor (Step 9) Omitted | | | | |
| 24 | 44 | 70 | 58 | 60 |
| B. Tests with Fatliquor (Step 9) included | | | | |
| 44 | 60 | 79 | 68 | 77 |

A higher number in this test represents a softer leather and conversely a lower number represents a firmer leather.

Both water resistance and lubrication effects are realized by the use of the composition of the subject invention on Trostel cowhide grains. A definite ability to open up cowhide structure is demonstrated, this being a characteristic which very few materials at low levels of application can accomplish. Retan effects such as a more unique and lighter chrome color and reduction of surface stock harshness is realized but a filling of the leather does not occur despite the plumpness and resinous feel that it is imparted in the wet condition. This plumpness and feel is apparently related to the opening up and hydrophobicity characteristics imparted by these sytems. Low level applications in such areas as shoe uppers, gloves, garments, etc. are useful and that the compositions may be used with any type of leather such as deer skin, cow splits, etc.

We claim:

1. In a method of treating leather stock whose wrung split shave weight is normally 40 to 50 percent by weight of water, comprising A. washing the stock in 400 percent water for 15 minutes and draining, B. refloating the stock for 30 minutes in 100 percent water at 80° F and neutralizing with 0.06% sodium bicarbonate, C. washing the stock in a float at 130° F for 10 minutes and draining, D. adding 2 to 10 percent by weight of solids of a leather treating composition (syntan) per 100 percent at 130° F and running for 1½ hours, E. adjusting the system with formic acid to the lowest equilibrium pH and running for 15 minutes, F. further adjusting the system with formic acid to a pH of 3.5 and running for an additional 15 minutes, G. washing the stock for 10 minutes in cold water, H. heating the stock to 130° F, washing for 10 minutes and draining, I. fat-liquoring the stock with 8 percent solids per 100 percent float at 130° F with a fat liquor consisting of an emulsified oil whose emulsifier is of a nonrewetting character, J. rinsing the stock, washing for 10 minutes and horsing up the stock, K. rinsing out the stock and tacking it up to dry in an oven at 140 degrees F for 4 hours, L. allowing the stock to lay over for 3 days to pick up moisture, and M. drying and staking the stock, the improvement which comprises using a leather treating composition in step D comprising an alkyl phenol - polyphenol condensate which has been alkoxylated and phosphated, and in which A. the alkyl phenol is selected from at least one of a group consisting of saturated or unsaturated linear or branched chain $C_6$ to $C_{20}$ alkyls, B. the phenol moiety of the alkyl phenol is selected from at least one of a group consisting of phenols, thiophenols, and phenols substituted with at least one member of the group consisting of hydroxyl radicals, halogen atoms, nitro radicals, methyl radicals, ethyl radicals, propyl radicals and phenyl radicals.

C. the polyphenol is selected from at least one of a group consisting of fused ring, polyaryl, and polyaralkyl polyphenols having from 2 to 15 benzene rings per molecule, including polyphenols substituted with at least one member of the group consisting of hydroxyl radicals, halogen atoms, nitro radicals, methyl radicals, ethyl radicals, and propyl radicals.

D. the alkyl phenol and polyphenol are joined by an aldehyde, substituted aldehyde, or aldehyde liberating composition.

E. the alkoxylating agent is selected from at least one of a group consisting of ethylene oxide, propylene oxide, butylene oxide and iso-butylene oxide, and F. the phosphating agent is selected from at least one of a group consisting of polyphosphoric acid, phosphoric acid, phosphorous pentoxide, pyrophosphoric acid, phosphorous acid, and phosphorous oxychloride, further characterized in that the total number of benzene rings contained in one molecule of the condensate is between 3 and 16.

2. A method according to claim 1 in which in the leather treating composition the aldehyde, substituted aldehyde or aldehyde liberating composition is selected from at least one of the group consisting of formaldehyde, paraformaldehyde, trioxane, hexamethylene tetramine, formalin, acetaldehyde, propanaldehyde, and butyraldehyde and the phosphating agent is selected from at least one of the group consisting of polyphosphoric acid, phosphoric acid and phosphorous pentoxide.

3. A method according to claim 1 in which in the leather treating composition the phenol moiety is selected from one of the group consisting of hydroxybenzene, alpha-naphthol and betanaphthol.

4. A method according to claim 1 in which in the leather treating composition the polyphenol is selected from at least one of a group consisting of di-(hydroxybenzene), bis-(hydroxybenzene), 2,2-bis(p-hydroxyphenyl) propane and 1,1-bis(p-hydroxyphenyl) ethane.

5. A method according to claim 1 in which in the leather treating composition the alkoxylating agent is ethylene oxide.

6. A method according to claim 1 in which in the leather treating composition the alkyl phenol is octyl phenol.

7. A method according to claim 1 in which in the leather treating composition the total number of benzene rings in the polyphenol is not less than 2 nor more than 15 and in which not less than 1 nor more than 14 moles of aldehyde are used to join not less than 1 nor more than 14 alkylphenols to the polyphenol.

8. A method according to claim 7 in which in the leather treating composition the polyphenol has not more than 7 benzene rings and in which not more than 6 alkylphenols are joined to the polyphenol, connected by not more than 6 moles of aldehyde.

9. A method according to claim 8 in which in the leather treating composition a polyphenol having 2 benzene rings is condensed with 2 alkyphenols by means of 2 moles of aldehyde.

10. A method according to claim 8 in which in the leather treating composition the alkoxylating agent is reacted with the alkylphenolpolyphenol condensate in the ration of from 1 to about 20 moles of alkoxylating agent per hydroxy moiety of the condensate.

11. A method according to claim 8 in which in the leather treating composition the phosphating agent is reacted with the alkoxylated alkylphenol-polyphenol condensate in the ratio of from about 0.25 to about 4 moles of phosphating agent per hydroxy moiety of the alkoxylated condensate.

* * * * *